US008302886B2

(12) United States Patent
Hashii et al.

(10) Patent No.: US 8,302,886 B2
(45) Date of Patent: Nov. 6, 2012

(54) FUEL INJECTION VALVE

(75) Inventors: Naoya Hashii, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 261 days.

(21) Appl. No.: 12/720,278

(22) Filed: Mar. 9, 2010

(65) Prior Publication Data

US 2011/0073683 A1 Mar. 31, 2011

(30) Foreign Application Priority Data

Sep. 29, 2009 (JP) ..... 2009-224581

(51) Int. Cl.
*F02M 61/00* (2006.01)

(52) U.S. Cl. ..... 239/533.12; 239/552; 239/556; 239/558; 239/585.1; 239/585.4

(58) Field of Classification Search ..... 239/533.12, 239/596, 552, 556, 558, 585.1, 585.4; *F02M 61/18, F02M 51/06*

See application file for complete search history.

(56) References Cited

U.S. PATENT DOCUMENTS

| | | | | |
|---|---|---|---|---|
| 5,002,231 | A * | 3/1991 | Reiter et al. | 239/585.1 |
| 5,335,864 | A * | 8/1994 | Romann et al. | 239/585.1 |
| 5,718,387 | A * | 2/1998 | Awarzamani et al. | 239/585.1 |
| 5,862,991 | A * | 1/1999 | Willke et al. | 239/397.5 |

FOREIGN PATENT DOCUMENTS

| | | | |
|---|---|---|---|
| JP | 2004-003518 | A | 1/2004 |
| JP | 2004-137931 | A | 5/2004 |
| JP | 2007-100515 | A | 4/2007 |
| JP | 2009-079598 | A | 4/2009 |
| JP | 2009-197682 | A | 9/2009 |
| WO | WO2008/117459 | * | 2/2008 |

* cited by examiner

*Primary Examiner* — Dinh Q Nguyen
(74) *Attorney, Agent, or Firm* — Sughrue Mion, PLLC

(57) ABSTRACT

In a fuel injection valve having a valve plug for opening and closing a valve seat in which fuel is injected from a plurality of orifices provided in an orifice plate mounted at the downstream side of the valve seat by operating the valve plug in response to an operation signal from a controller, a thin wall part is provided by concaving a center portion of an upstream-side end face of the orifice plate to the downstream side by press working, and the orifice plate is disposed so that a virtual circular conical surface extending to the downstream side of the valve seat surface and an upstream-side end face of the orifice plate of the outer peripheral side of the thin wall part intersect to each other to form one virtual circle.

4 Claims, 12 Drawing Sheets

ENLARGED K-K CROSS-SECTION

ENLARGED L-L CROSS-SECTION

ENLARGED B-B CROSS-SECTION

ENLARGED C-C CROSS-SECTION

ENLARGED E-E CROSS-SECTION

ENLARGED F-F CROSS-SECTION

ENLARGED H-H CROSS-SECTION

ENLARGED I-I CROSS-SECTION

FUEL INJECTION VALVE

BACKGROUND OF THE INVENTION

1. Field of the Invention

The present invention relates to a fuel injection valve for use in a fuel supply system of an internal combustion engine, and particularly to an electromagnetic type fuel injection valve that can perform promotion of atomization and suppression of dispersion of fuel spray shape in spray characteristic, and also can perform enhancement of flow rate precision and suppression of variation caused by ambient pressure variation in flow rate characteristic.

2. Description of the Related Art

Recently, exhaust gas regulation (emission limit) has been enforced to vehicles, etc., and under such a situation, it has been required to enhance atomization of fuel spray injected from a fuel injection valve. Various studies have been made on the atomization of fuel spray. For example, JP-A-2007-100515 discloses a technique of disposing a nozzle hole entrance portion inside with respect to the mainstream of fuel flow from a valve seat portion and also rapidly reducing the cavity flow passage area just above the nozzle hole to promote the fuel flow having a large plunge angle at the entrance of the nozzle hole, whereby the fuel spray is atomized while suppressing excessive fuel spray diffusion.

Furthermore, JP-A-2004-137931 discloses a technique of designing the orifice of an orifice plate so that the orifice length at the outside in the radial direction is shorter than the orifice length at the inside in the radial direction with respect to the axial center X of the fuel injection valve, thereby performing atomization of fuel injection with a simple structure.

FIG. 1 is a cross-sectional view showing the overall construction of a general fuel injection valve 1, and it is constructed by a solenoid device 2, a housing 3 serving as a yoke portion of a magnetic circuit, a core 4 as a fixed iron core portion of the magnetic circuit, a coil 5, an armature 6 as a movable iron core portion of the magnetic circuit, and a valve device 7. The valve device 7 is constructed by a valve plug 8, a valve main body 9 and a valve seat 10. The valve main body 9 is pressed and fitted around the outer-diameter portion (outer peripheral portion) of the core 4 and welded. The armature 6 is pressed and fitted into the valve plug 8, and then welded. The fuel spray plate 11 is inserted into the valve main body 9 under the state that the fuel spray plate 11 is bonded to the downstream side of the valve seat at a welding portion 11*a*, and then bonded to the valve seat 10 at a welding portion 11*b*. Plural fuel orifices 12 penetrating through the plate thickness direction are formed in the fuel spray plate 11 by press forming.

FIGS. 8 to 11 are detailed cross-sectional views of the tip portion of a fuel injection valve, which particularly correspond to FIG. 5 of JP-A-2007-100515. Next, the operation of the fuel injection valve will be described with reference to FIG. 1 as well as FIGS. 8 to 11.

When an operation signal is transmitted from a control device (not shown) for an engine to the driving circuit of the fuel injection valve 1, current is made to flow through the coil 5, and a magnetic flux occurs in the magnetic circuit comprising the armature 6, the core 4, the housing 3 and the valve main body 9. The armature 6 is operated to be attracted to the core 4 side, and the valve plug 8 which is designed integrally with the armature 6 is separated from the valve seat face 10*a*, whereby a gap 17*a* is formed.

At this time, fuel is passed from a chamfered portion 13*a* of a ball 13 welded to the and portion of the valve plug 8 through the gap between the valve seat face 10*a* and the valve plug 8, and injected from plural orifices 12 into an engine intake pipe. Subsequently, when an operation stop signal is transmitted from the control device of the engine to the driving circuit of the fuel injection valve, supply of current to the coil 5 is stopped, and the magnetic flux in the magnetic circuit is reduced, so that the gap 17*a* between the tip portion 13 of the valve plug and the valve seat face 10*a* is closed by a compression spring 14 which presses the valve plug 18 in a valve closing direction, whereby the fuel injection is finished. The valve plug 8 slides along a guide portion of the valve main body 9 at a side surface 6*a* of the armature 6, and under a valve open state, an upper surface 6*b* of the armature 6 abuts against the lower surface of the core 4.

In the system of JP-A-2007-100515, a projecting portion 11*d* projecting to the downstream side is provided at the center portion of the orifice plate, and the orifice plate 11 is disposed so that a virtual circular conical surface 10*b* extending to the downstream side of the valve seat surface 10*a* and an orifice arrangement surface 11*c* at the outer peripheral side of the projecting portion intersect to each other to form one virtual circle 15 (see FIG. 9). Therefore, fuel flowing along the sheet surface 10*a* plunges into the orifice entrance portion 12*a*, and then pressed against the inner wall 12*e* of the orifice, whereby the fuel flow is converted to fuel flow 16*d* (see FIG. 10) along the curvature of the orifice. At this time, the optimum orifice length is required to form falcate liquid film in the orifice. If the length is excessively long, the fuel goes round in the orifice and thus becomes a string of sprayed fuel. If the length is excessively short, the fuel flow is not sufficiently converted to the flow along the curvature of the orifice, so that not only the fuel becomes a string of sprayed fuel, but also the actual injection angle of the fuel is smaller than a desired injection angle.

Furthermore, in the cross-section passing through the axial center 13*e* of the valve plug and the center of the orifice, the distance between a first parallel line 18*a* parallel to the valve seat face 10*a* passing through the inside 12*c* in the radial direction of the axial center X of the fuel injection valve of the orifice entrance portion 12*a* and a second parallel line 18*b* parallel to the valve seat face 10*a* passing through the outside 12*d* in the radial direction of the fuel hole entrance portion is maximum when the angle θ between the valve seat face 10*a* and the plane 11*c* on which the orifice is disposed is equal to 90°, and also is minimum when the angle concerned is equal to 0°.

In the structure disclosed in JP-A-2007-100515 (prior art 1), the orifice entrance portion 12*a* is disposed on the plane 11*c* perpendicular to the axial center of the valve plug, and thus the intersecting angle θ between the valve seat face 10*a* and the orifice arrangement plane 11*c* is large, and the distance between the parallel lines described above is large. Therefore, the distance to the exit of the orifice is different between the fuel impinging against the inside 12*c* in the radial direction of the center axis X of the fuel injection valve of the orifice entrance portion 12*a* and the fuel which passes through the outside 12*d* in the radial direction of the orifice entrance portion 12*a* and impinges against the inside 12*e* in the radial direction of the axial center X of the fuel injection valve of the orifice wall. Therefore, the orifice length which is optimum to atomization with respect to both the fuels does not exist in the structure concerned.

Particularly, there is a case where not increase of the number of orifices, but increase of the orifice diameter is required from the viewpoint of the layout performance of the orifice particularly in order to apply the fuel injection valve to a large flow-rate specification. In this case, the distance between the inside 12*c* and outside 12*d* in the radial direction of the axial center X of the fuel injection valve at the orifice entrance portion 12*a* is large due to the increase of the orifice diameter, and thus the particle size of the atomized fuel deteriorates. Furthermore, in order to implement a large injection angle, it is required to increase the inclination angle of the orifice. In this case, the flatness rate of the shape of the orifice entrance is increased, so that the distance between the inside 12*c* and outside 12*d* in the radial direction of the axial center X of the fuel injection valve at the orifice entrance portion 12*a* is increased, and thus there is a problem that the particle size of the atomized fuel deteriorates.

FIGS. 12 to 15 are detailed cross-sectional views of the tip portion of the fuel injection valve disclosed in JP-A-2004-137931 (prior art), and the operation of the fuel injection valve will be described with reference to FIG. 1 as well as FIGS. 12 to 15.

In this type of fuel injection valve, the orifice of the orifice plate is designed so that the orifice length at the outside in the radial direction is shorter than the orifice length at the inside in the radial direction with respect to the center axis X of the fuel injection valve. However, the upstream end face 11*c* of the orifice plate 11 is planar, and thus in the fuel flow, main-streams 16*a* and 16*b* passing through the gap between the valve plug 8 and the valve seat 10 and advancing toward the orifice and a radial U-turn stream 16*c* passing through the orifices and turning around due to counter flow at the center of the orifice plate crash head-on just above the orifice, and the main streams are decelerated.

When the main stream is decelerated as described above, the force of pressing fuel against the inner wall 12*e* at the inside in the radial direction of the axial center X of the fuel injection valve of the orifice is weakened, and the thickness of the liquid film formed inside the orifice is larger, so that atomization deteriorates. Furthermore, when turbulence is generated in the fuel flow, there is obtained an effect of promoting disruption of the liquid film of fuel injected from the orifice by the energy of the turbulence. However, droplets which are once separated from the liquid film and formed are difficult to be further disrupted due to the effect of the surface tension.

Therefore, in the system of atomizing fuel spray by forming falcate liquid film in the orifice, it has been proved from a fuel spray observation result that atomization is more promoted by disrupting liquid film after the liquid film injected in a falcate shape from the orifice spreads and thus the liquid film is thinner, and it is more advantageous in atomization to reduce the turbulence in the fuel flow.

As described above, the fuel injection disclosed in JP-A-2004-137931 has a problem that the particle size of fuel spray deteriorates because turbulence occurs in the fuel flow at the orifice entrance portion due to the frontal crash.

With respect to the problems, a structure obtained by combining a concave portion disclosed in JP-A-2004-137931 with the technique disclosed in JP-A-2007-100515 as shown in FIGS. 16 to 19 is an effective method of respectively optimizing the distance to the orifice exist with respect to the fuel which impinges against the inside 12*c* in the radial direction of the axial center X of the fuel injection valve of the orifice entrance portion 12*a*, and the distance to the orifice exit with respect to the fuel which passes through the outside 12*d* in the radial direction of the orifice entrance portion 12*a* and impinges against the inside 12*e* in the radial direction of the axial center X of the fuel injection valve of the orifice wall. However, this method has the following problem in mass productivity.

That is, with respect to the processing of the orifice plate, a method of successively processing a strip-shaped plate member called as hoop material by press working which is excellent in processing cost and processing precision is used as a method best in cost and quality in consideration of mass productivity. In the case of a symmetrical two-spray type fuel injection valve adapted to a single cylinder or two-valve engine, the shape of the orifice is also symmetrical. Therefore, in order to reduce the metal mold cost, enhance the quality and promote the space efficiency of a factory, a hoop material is reeled off after the orifices at one side are processed, and then the orifices at the opposite side are processed by using the same metal mold.

Furthermore, a burr removing step and a cleaning step after the orifice processing, a step of cutting out a plate from the hoop material, etc. are provided in addition to the orifice processing. If the respective steps are linked to one another on a line, the space efficiency of the factor deteriorates, and there are cumbersome problems of product inspection in every step, a treatment to processing failure, etc. Furthermore, since the respective steps are made independent of one another, except for the final step of cutting out the plate from the hoop material, the hoop material is reeled off every step. In the structure that a projecting portion is provided at the center portion of the orifice plate as in the case of the technique disclosed in JP-A-2007-100515, it is impossible to carry out the reel-off of the hoop material after the projecting portion is formed because the projecting portion and the plate interfere with each other. Therefore, the formation of the projecting portion at the center portion of the orifice plate is required to be carried out just before the final step of cutting out the plate from hoop material.

In the structure that the concave portion disclosed in JP-A-2004-137931 is combined with the technique disclosed in JP-A-2007-100515 as shown in FIGS. 16 to 19, the formation of the concave portion is required to be executed before the orifice processing in consideration of deformation of the orifices, and all the steps are shown in FIG. 20. In FIG. 20, reference numeral 50 represents the hoop material, and reference numeral 60 represents pilot pin guides. The concave portion corresponding to each orifice in step 1 is formed by forge-formation, for example. In step 2, the orifice processing (one side) is executed by press blanking. In step 3, the orifice processing (opposite side) is executed by press blanking. After the orifice processing, burr is removed by brush machining, for example, and then cleaning is executed.

Subsequently, in step 4, the projecting portion at the center portion of the plate is formed by stretch forming. In the final step 5, the orifice plate is cut out by press blanking, drawing or the like. It is needless to say that the movement between the respective steps is performed by reeling off the hoop material 100. FIGS. 21A and 21B are enlarged views of the detailed structure of the orifice plate in the stretch forming step, wherein FIG. 21A shows a state before the stretch forming step, and FIG. 21B shows a state during the stretch forming step. In FIGS. 21A and 21B, reference numeral 70 represents a punch, reference numeral 71 represents a punch guide, reference numeral 80 represents a dice, reference numeral 81 represents a dice guide, reference numeral 11 represents the orifice plate, and reference numeral 320 represents the concave portion.

In FIG. 21A, Y represents a deformed portion (boss portion) which is formed on the end face at the upstream side of the plate when the concave portion 20 is formed on the end face at the downstream side of the orifice plate 11. The dice guide 81 is disposed at both the sides of the dice 80 serving as a stretch forming mold for the orifice plate, and the orifice plate 11 having the concave portion corresponding to each orifice formed therein is mounted on the dice guide 81. Subsequently, the punch guide 71 strokes to pinch the outer peripheral portion of the orifice plate 11.

At this time, a gap G occurs between the plate 11 and the punch guide 71 due to the deformed portion Y of the end face at the upstream side of the plate. Accordingly, in the subsequent stretch forming step of the projecting portion at the center portion of the orifice plate, the punch 70 strokes, and the formation of the projecting portion at the center portion of the orifice plate is started as shown in FIG. 21B. At this time, it is impossible to sufficiently press the orifice plate by the metal mold due to existence of the gap G, and thus drawing is executed. Accordingly, there is a problem that a deformed portion Z is formed in the orifice around the projecting portion in FIG. 21B.

In order to solve the problem of the deformation of the orifices, it is required to form the projecting portion before the orifice processing or the step of forming the concave portion corresponding to each orifice. However, as described above with reference to FIG. 20, it is impossible to reel off the hoop material after the projecting portion is formed, and thus it is required to link the respective steps on a line. Therefore, there is a problem in cost and quality management.

SUMMARY OF THE INVENTION

Therefore, an object of the present invention is to implement atomization of fuel spray in low cost without inducing turbulence in fuel flow at an orifice entrance portion even in the case of a large flow-rate specification in the fuel orifice for an internal combustion engine.

In order to attain the above object, according to a fuel injection valve according to the present invention, a center portion of the end face at the upstream side of an orifice plate is recessed to form a thin wall part which is substantially parallel to the tip portion of a valve plug, and the orifice plate is disposed so that a virtual circular conical surface extending to the downstream side of a valve seat face and the end face at the upstream side of the orifice plate at the outer peripheral side of the thin wall part intersect to each other to form one virtual circle.

The distance to the orifice exit of fuel which passes through the outside in the radial direction of the center axis X of the fuel injection valve of the orifice entrance portion and impinges against the inside in the radial direction of the orifice wall, and the distance to the orifice exit of fuel which impinges against the inside in the radial direction of the axial center X of the fuel injection valve of the orifice entrance portion can be respectively optimized. In the case of a large flow-rate specification or a large spray-angle specification, an excellent atomization characteristic of fuel spray can be obtained without occurrence of turbulence in fuel flow at the orifice entrance portion.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENT

A preferred embodiment according to the present invention will be described with reference to the accompanying drawings.

Embodiment 1

FIGS. 1 to 6 are cross-sectional views of the respective parts of a fuel injection valve according to an embodiment 1.

Figure 1:
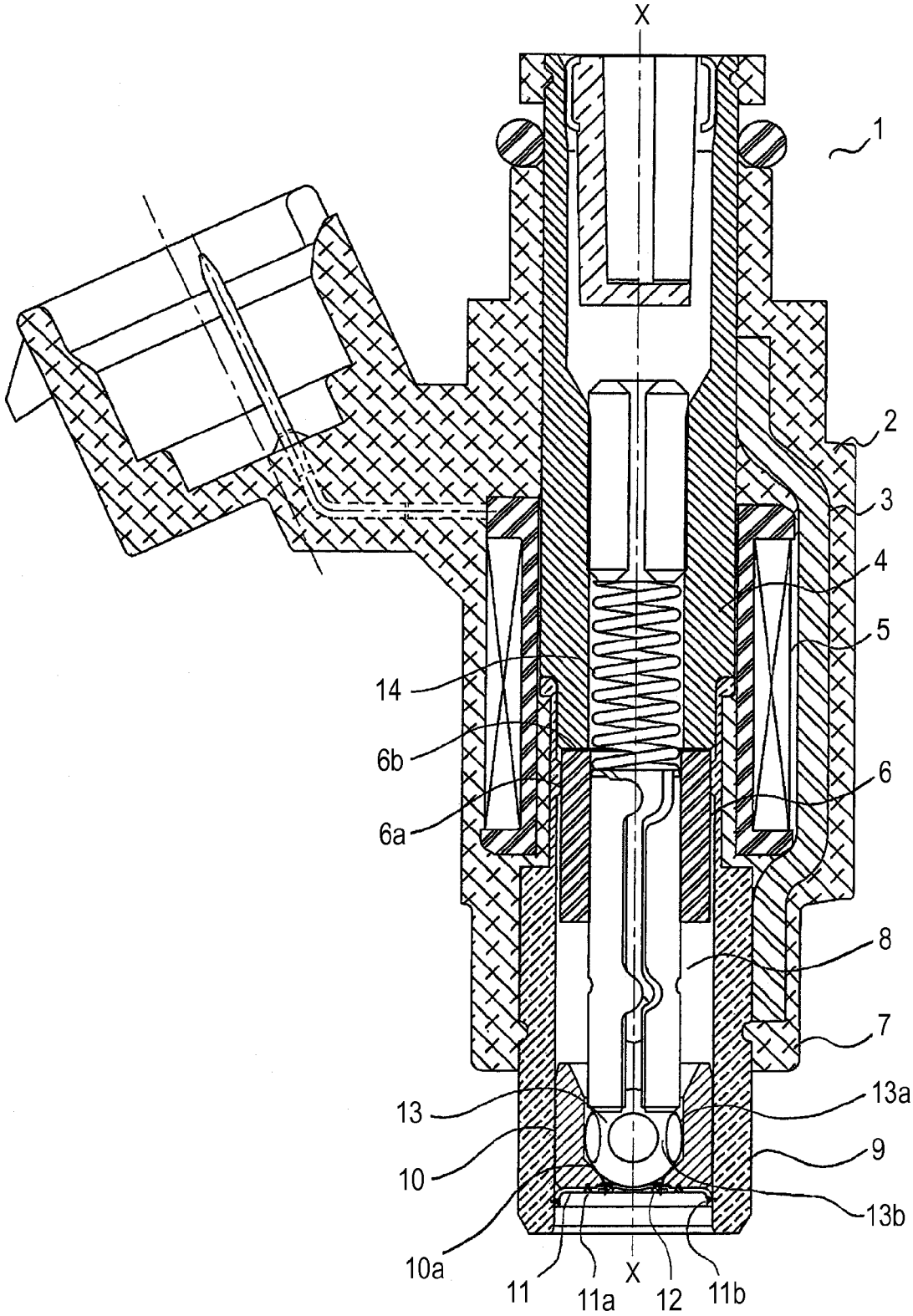
FIG.1 PRIOR ART
FIG. 1 is a cross-sectional view showing the overall construction of a fuel injection valve.
Figure 2:
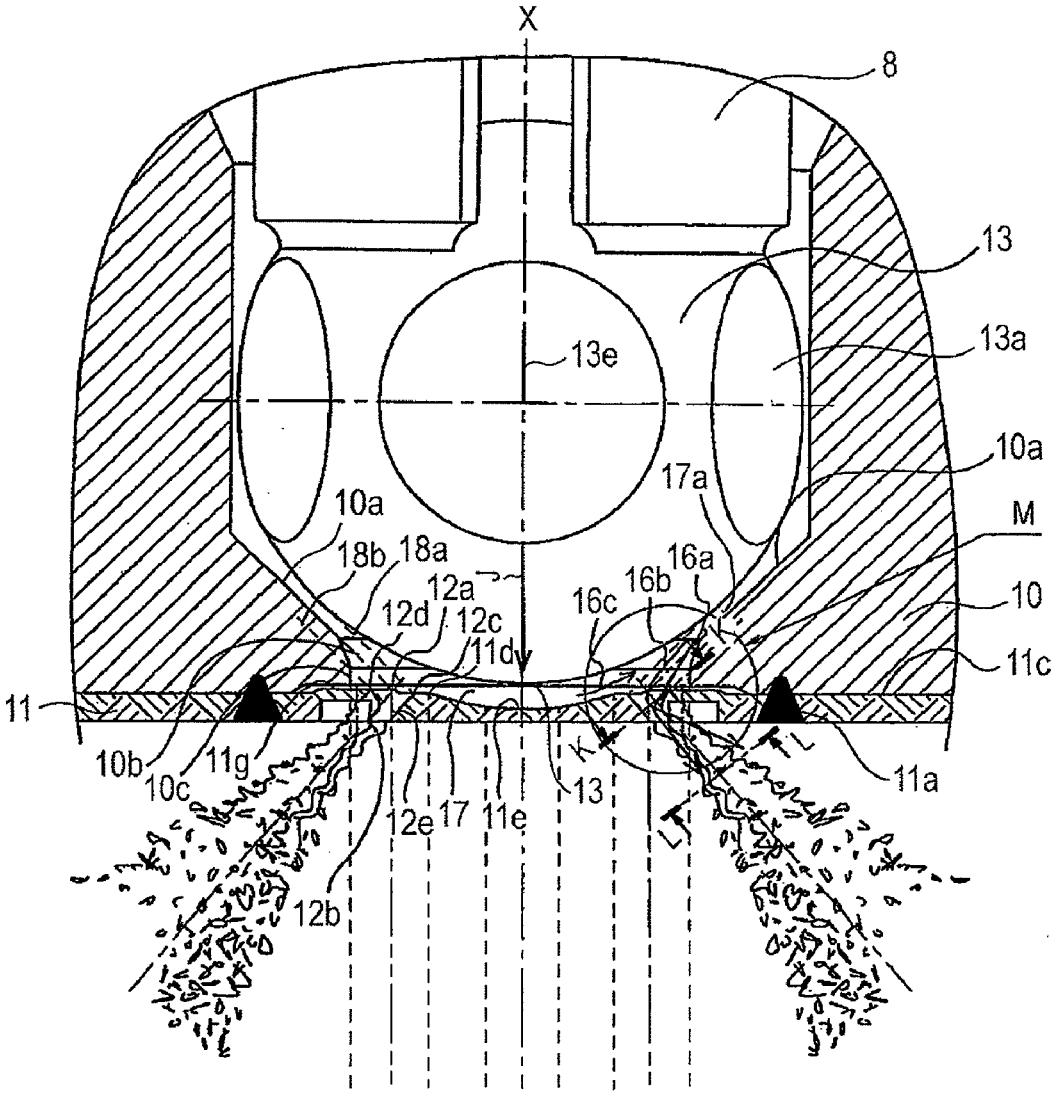
FIG. 2 is a detailed cross-section of the tip portion of the fuel injection valve according to an embodiment of the present invention.
Figure 3:
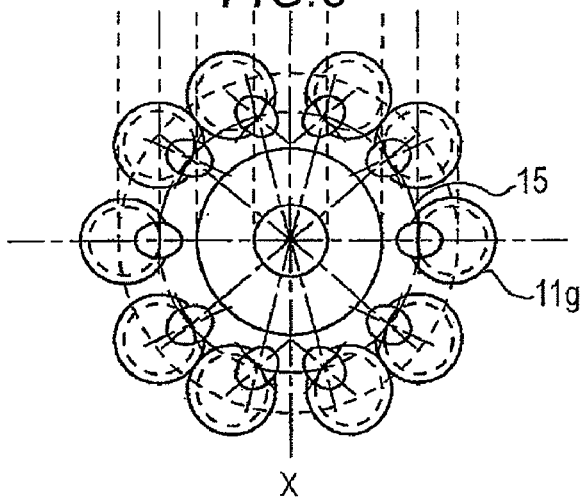
FIG. 3 is a partially plan view when viewed from an arrow J of FIG. 2.
Figure 4:
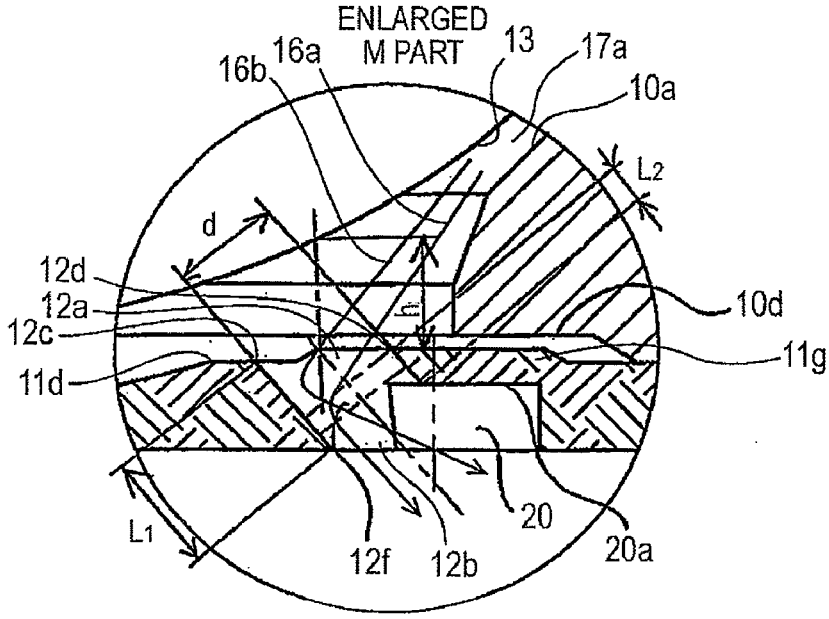
FIG. 4 is an enlarged view of an M part of FIG. 2.
Figure 5:
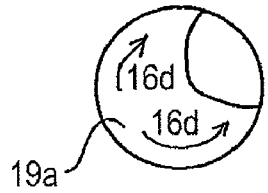
FIG. 5 is an enlarged cross-sectional view taken along K-K of FIG. 2.
Figure 6:
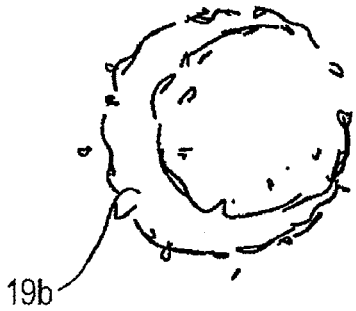
FIG. 6 is an enlarged cross-sectional view taken along L-L line of FIG. 2.

The construction and operation of the fuel injection valve shown in FIG. 1 are the same of the prior arts described above, and the duplicative description thereof is omitted. FIG. 2 is a detailed cross-sectional view of the tip portion of the fuel injection valve according to the embodiment 1, FIG. 3 is a partial plan view when viewed from an arrow J of FIG. 2, FIG. 4 is an enlarged view of an M part of FIG. 2, FIG. 5 is an enlarged cross-sectional view taken along K-K line, and FIG. 6 is an enlarged cross-sectional view taken along L-L line. In these figures, the same reference numerals as FIGS. 8 to 19 represent the same or corresponding parts.

The fuel injection valve according to the embodiment 1 has the thin wall part 11*e* which is obtained by concaving the center portion of the upstream-side end face 11*c* of the orifice plate 11 to the downstream side by press working so that the thin wall part 11*e* is substantially parallel to the tip portion 13 of the valve plug, and the orifice plate 11 is disposed so that the virtual circular conical surface 10*b* extending to the downstream side of the valve seat surface 10*a* and the upstream-side end face 11*c* of the orifice plate at the outer peripheral side of the thin wall part 11*e* intersect to each other to form one virtual circular 15 (see FIG. 3).

The entrance portion 12*a* of the orifice is disposed at the outside of the thin wall part 11*e* and at the inside of the valve seat opening inner wall 10*c* corresponding to the minimum inner diameter of the valve seat, and also the exit portion 12*b* of the orifice is disposed at the outside in the radial direction of the axial center X of the fuel injection valve with respect to the entrance portion 12*a* (see FIG. 4).

Accordingly, when the valve plug is opened, a fuel stream 16*a* impinging against the inside 12*c* in the radial direction of the axial center X of the fuel injection valve of the orifice entrance portion 12*a* and a fuel stream 16*b* which passes through the outside 12*d* in the radial direction of the orifice entrance portion 12*a* and impinges against the inside 12*e* in the radial direction of the axial center X of the fuel injection valve of the orifice wall are formed as fuel main streams directing from the gap 17*a* between the valve plug tip portion 13 and the valve seat surface 10*a* to the wall 12*e* of the inside in the radial direction of the axial center X of the fuel injection valve of each orifice.

Furthermore, the cavity height represented by the distance in the valve seat axial direction from the upstream-side end face 11*c* of the orifice plate to the valve plug tip portion 13 is substantially fixed from the center of the orifice plate to the outermost diameter portion lid of the thin wall part, however, it increases from the outermost diameter portion 11*d* of the thin wall part lid to the valve seat opening inner wall 10*c*. Therefore, fuel main streams 16*a* and 16*b* at valve opening can hide under the U-turn stream 16*c* which is radiated from the outermost diameter portion 11*d* of the thin wall part along the cavity shape of the thin wall part, and thus the fuel main streams and the U-turn stream do not crash head-on, so that the fuel main streams are not decelerated and the turbulence of fuel is little.

Accordingly, the liquid film 19*a* (see FIG. 5) formed by strongly pressing fuel against the orifice wall 12*e* is further thinned by flow separation at the orifice entrance portion 12*a*. Thereafter, the fuel flow in the orifice becomes a fuel stream 16*d* along the curvature of the orifice, and it is radiated as falcate liquid film 19*b* from the orifice exit 12*b*, whereby atomization can be promoted (see FIG. 6).

Figure 7:
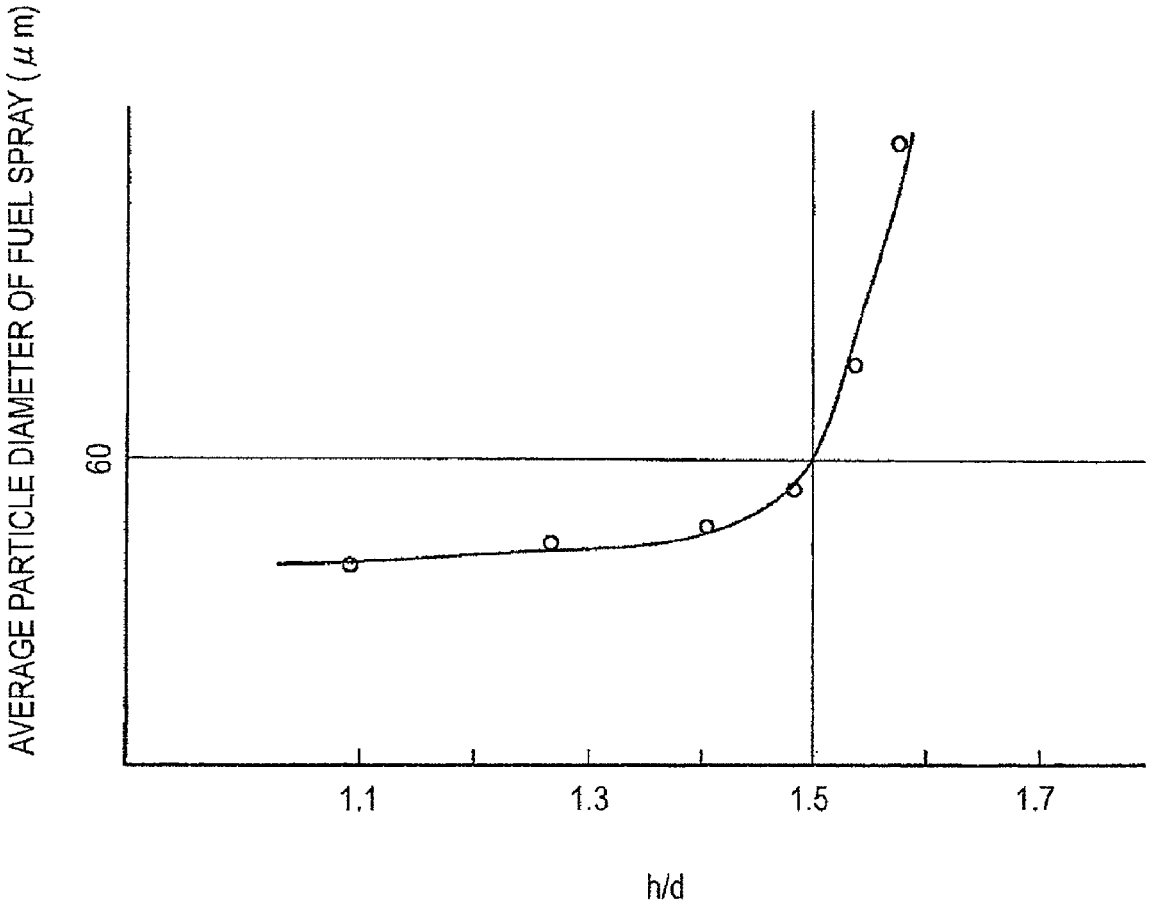
FIG. 7 is a characteristic diagram showing the relation between the shape of the orifice entrance portion and the average particle size of fuel spray.
Figure 8:
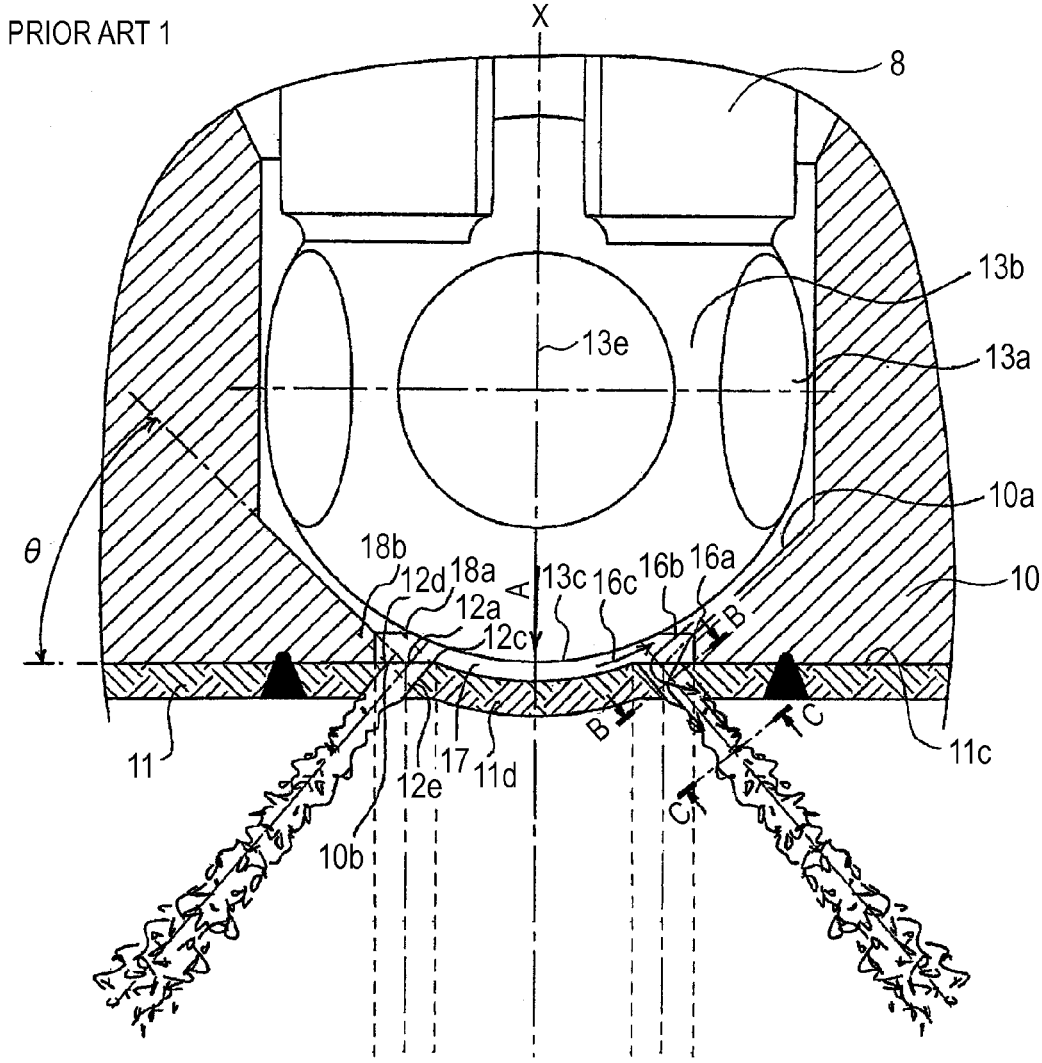
FIG.8 PRIOR ART
FIG. 8 is a detailed cross-sectional view of the tip portion of a fuel injection valve of a prior art 1.
Figure 9:
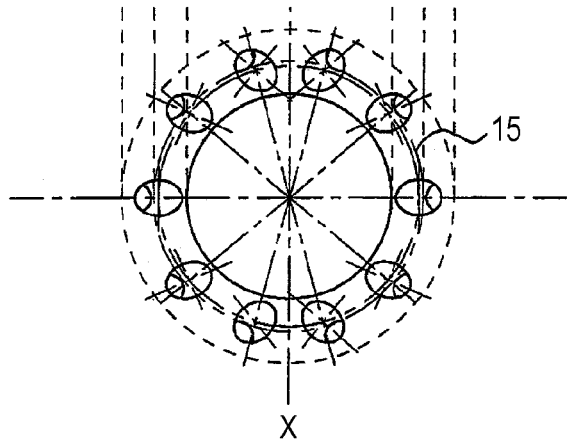
FIG.9 PRIOR ART
FIG. 9 is a partial plan view when viewed from an arrow A of FIG. 8.
Figure 10:
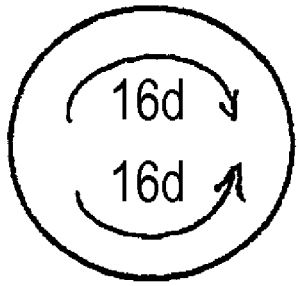
FIG.10 PRIOR ART
FIG. 10 is an enlarged cross-sectional view taken along B-B line of FIG. 8.
Figure 11:
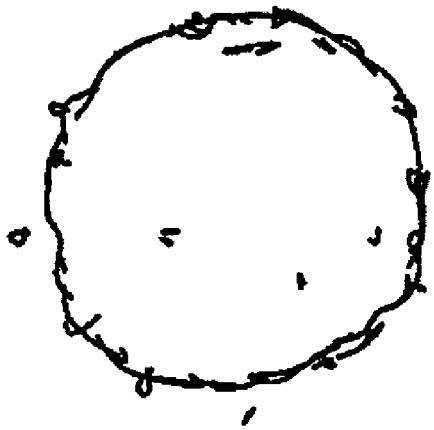
FIG.11 PRIOR ART
FIG. 11 is an enlarged cross-sectional view taken along C-C line of FIG. 8.
Figure 12:
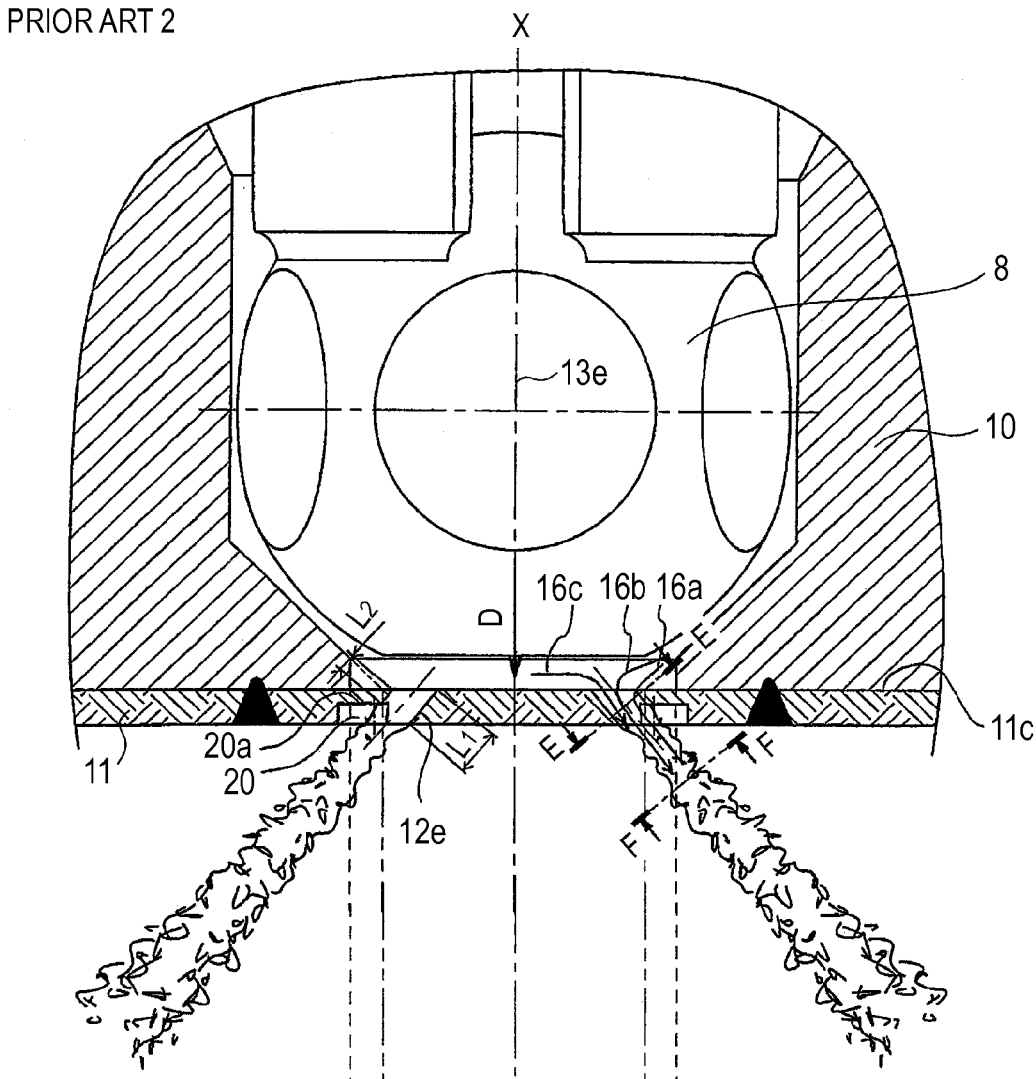
FIG.12 PRIOR ART
FIG. 12 is a detailed cross-sectional view of the tip portion of a fuel injection valve of a prior art 2.
Figure 13:
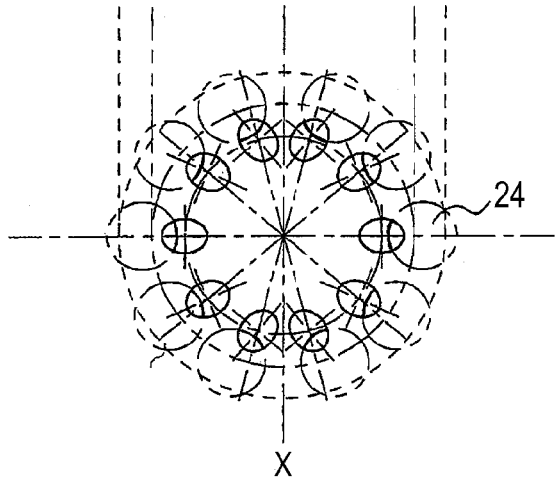
FIG.13 PRIOR ART
FIG. 13 is a partial plan view when viewed from an arrow D of FIG. 12.
Figure 14:
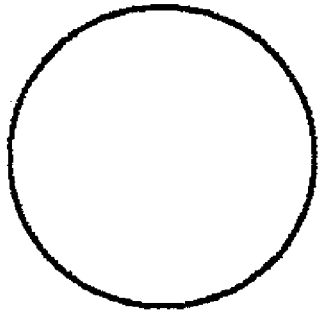
FIG. 14 PRIOR ART
FIG. 14 is an enlarged cross-sectional view taken along E-E line of FIG. 12.
Figure 15:
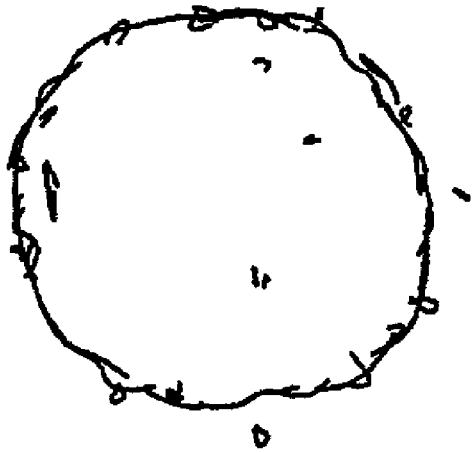
FIG. 15 PRIOR ART
FIG. 15 is an enlarged cross-sectional view taken along F-F line of FIG. 12.
Figure 16:
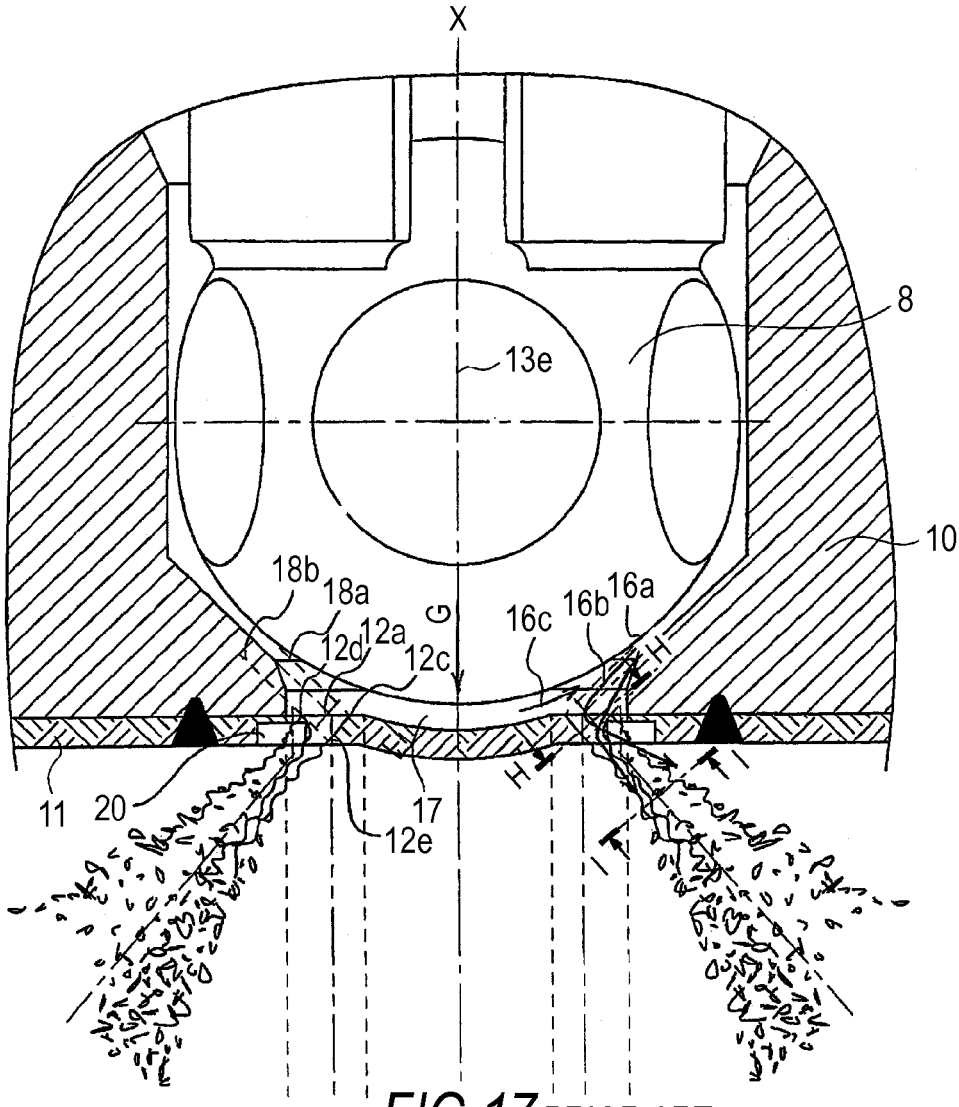
FIG.16 PRIOR ART
FIG. 16 is a detailed cross-sectional view of the tip portion of a fuel injection valve obtained by combining the prior art 1 with the concave portion of the prior art 2.
Figure 17:
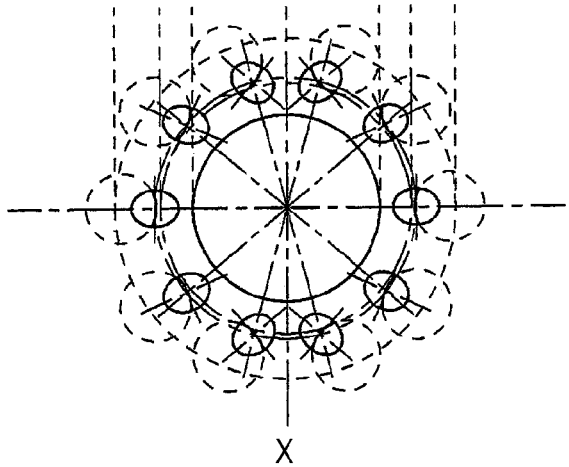
FIG.17 PRIOR ART
FIG. 17 is a partial plan view when viewed from an arrow G of FIG. 16.
Figure 18:
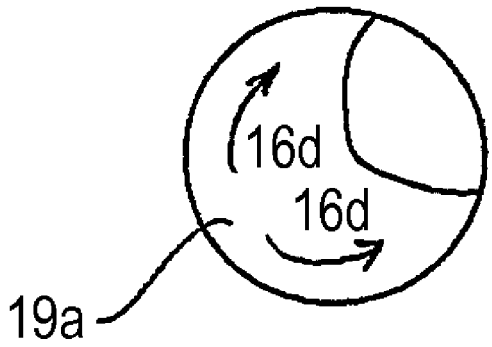
FIG. 18 PRIOR ART
FIG. 18 is an enlarged cross-sectional view taken along H-H line of FIG. 16.
Figure 19:
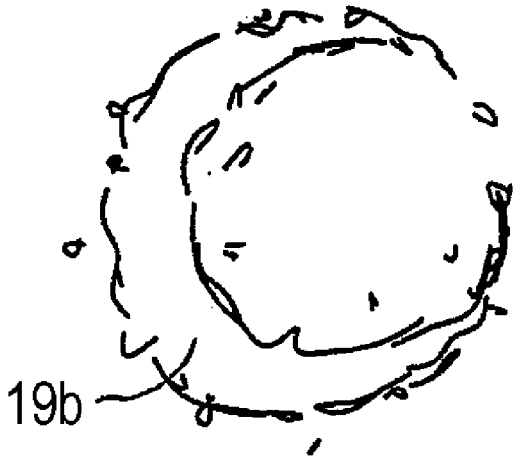
FIG. 19 PRIOR ART
FIG. 19 is an enlarged cross-sectional view taken along I-I line of FIG. 16.
Figure 20:
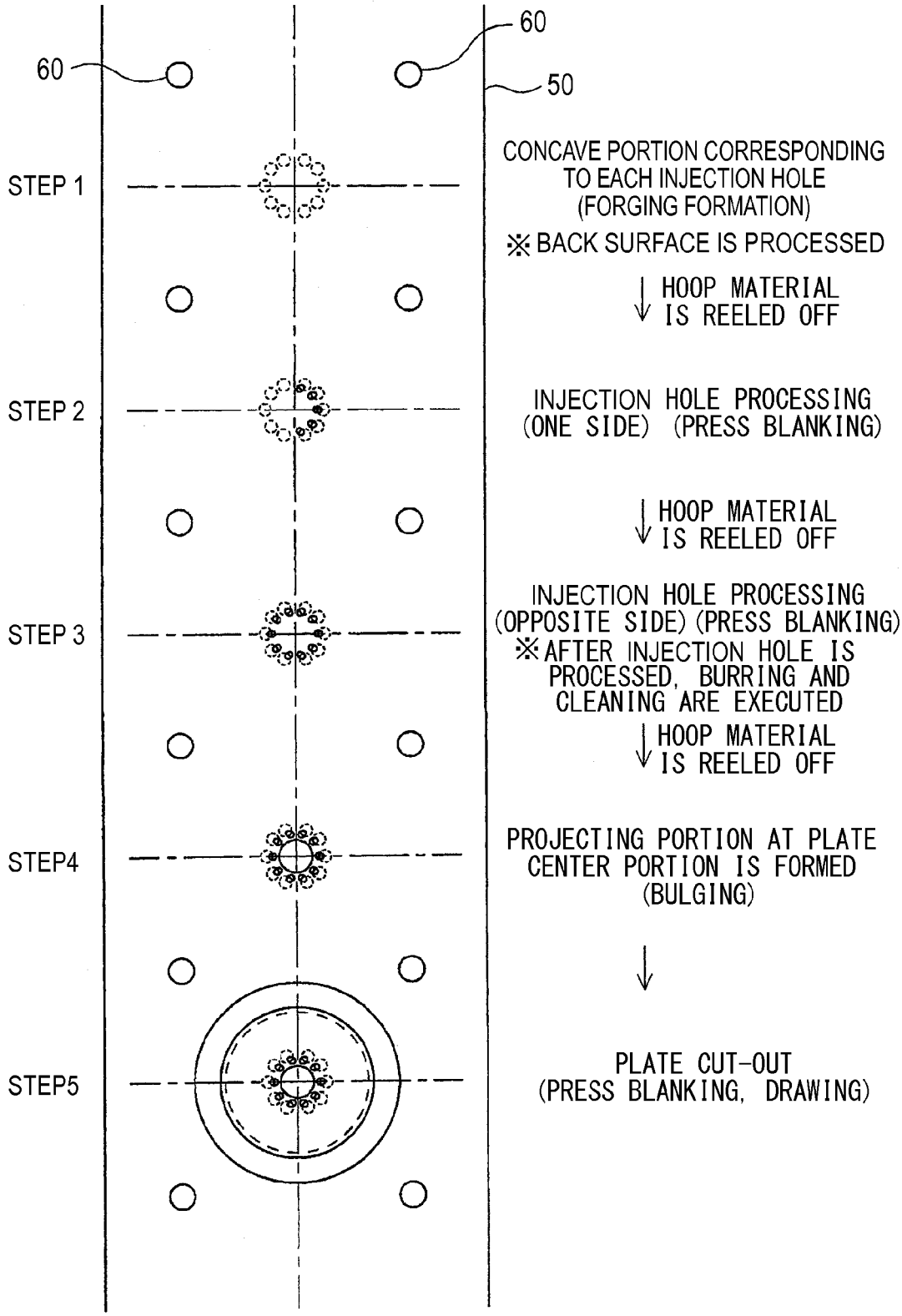
FIG.20 PRIOR ART
FIG. 20 is a diagram showing a processing step of an orifice plate of a fuel injection valve obtained by combining the prior art 1 with the concave portion of the prior art 2.
Figure 21A:
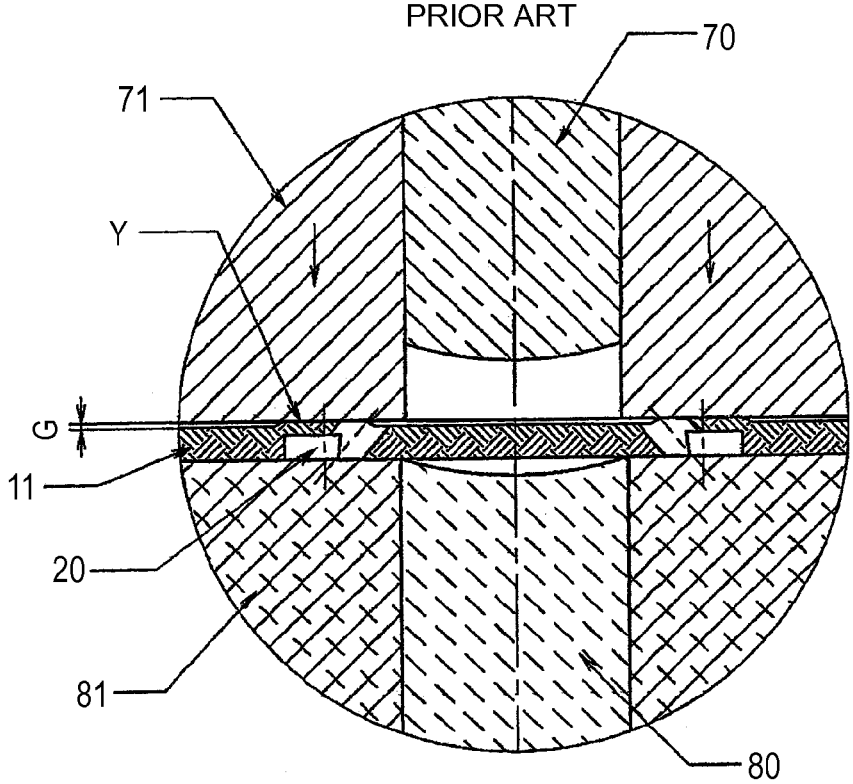
FIG.21A PRIOR ART
FIG. 21 is a diagram showing the detailed construction of the orifice plate based on the system of FIG. 16 in a stretch forming step.
Figure 21B:
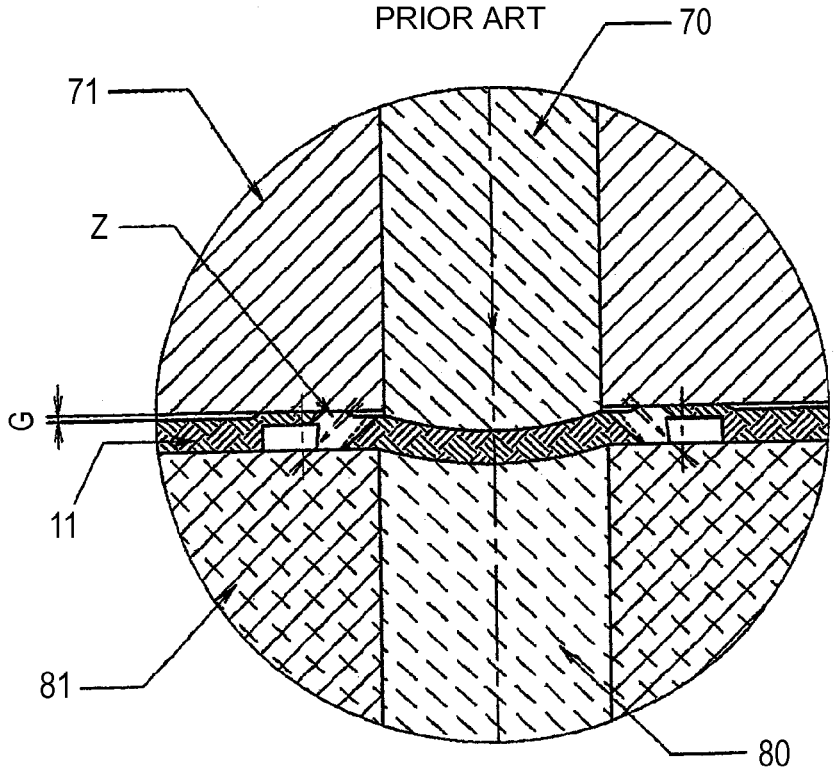
FIG.21B PRIOR ART

Furthermore, FIG. 7 shows an experimental result obtained by investigating an effect of the ratio h/d on the average particle diameter (μm) of fuel spray, wherein h represents a height just above the orifice (hereinafter referred to as "orifice just-above height") represented by the distance in the valve seat axial direction between the center of the orifice entrance portion 12*a* and the valve plug tip portion 13, and d represents the orifice entrance diameter. As is apparent from FIG. 7, by setting $h \leqq 1.5$ d under a valve-open state, the flow direction at the orifice entrance portion 12*a* is rapidly changed while the fuel main stream keeps a high flow rate, so that atomization can be promoted.

Still furthermore, each concave portion 20 is formed in correspondence to the exit portion of the orifice by press working so that the orifice length L2 of the outside in the radial direction of the axial center X of the fuel injection valve is shorter than the orifice length L1 of the inside in the radial direction (see FIG. 4) with respect to each orifice, and each orifice is formed by press working so as to stride over the bottom surface 20*a* of the concave portion.

Accordingly, even when the distance between the inside 12*c* and the outside 12*d* in the radial direction of the axial center X of the fuel injection value at the orifice entrance portion 12*a* is increased due to the increase of the orifice diameter for the large flow-rate specification and the increase of the inclination angle of the orifice for the large spray-angle specification, the distance to the orifice exit of the fuel which passes through the outside 12*d* in the radial direction of the axial center X of the fuel injection valve at the orifice entrance portion 12*a* and impinges against the inside 12*e* in the radial direction of the orifice wall, and the distance to the orifice exit 12*b* of the fuel which impinges against the inside 12*c* in the radial direction at the orifice entrance portion can be respectively optimized. Therefore, the atomization of fuel spray can be performed irrespective of the flow-rate specification and the spray specification.

Furthermore, according to the fuel injection valve of the embodiment 1, as shown in the enlarged view of FIG. 4, a columnar portion 12*f* having the minimum cross-section area is secured between the orifice entrance portion 12*a* and the concave portion 20 in the flow passage of the orifice 12. The flow rate is determined by the cross-section area of the columnar portion 12*f*, and thus by securing the columnar portion 12*f* having the minimum cross-section area, dispersion of the flow rate which is caused by positional dispersion of the orifice 12 and the concave portion 20 can be suppressed.

Still furthermore, according to the fuel injection valve of the embodiment 1, a counter bore 10*d* is provided to the valve seat to prevent interference with a deformed portion 11*g* at the upstream side of the plate which occurs when the concave portion 20 is formed at the downstream side of the orifice plate by press working.

When the orifice plate 11 and the valve seat 10 are welded to each other by laser welding at a welding place 11*a* of FIG. 2, occurrence of a gap at the welding place of the outer peripheral portion of the orifice can be suppressed by forming the counter bore 10*d*, and thus dispersion of welding can be improved.

Furthermore, according to the fuel injection valve of the embodiment 1, the thin wall part is formed by concaving the center portion of the upstream-side end face of the orifice plate so that the thin wall part is substantially parallel to the tip portion of the valve plug without forming any projecting portion at the center portion of the orifice plate. Therefore, the hoop material can be reeled off even after the thin wall part is formed at the center portion of the orifice plate, and thus the projecting portion can be formed before the orifice forming step or the step of forming the concave portion corresponding to each orifice, so that the mass productivity of the orifice plate can be enhanced.

Various modifications and alterations of this invention will be apparent to those skilled in the art without departing from the scope and spirit of this invention, and it should be understood that this is not limited to the illustrative embodiments set fourth herein.

What is claimed is:

1. A fuel injection valve having a valve plug for opening and closing a valve seat in which fuel is injected from a plurality of orifices provided in an orifice plate mounted at the downstream side of the valve seat by operating the valve plug in response to an operation signal from a controller, wherein a thin wall part is provided by concaving a center portion of an upstream-side end face of the orifice plate so that the thin wall part is substantially parallel to the tip portion of the valve plug without forming any projecting portion to the downstream side by press working, and the orifice plate is disposed so that a virtual circular conical surface extending to the downstream side of the valve seat surface and an upstream-side end face of the orifice plate of the outer peripheral side of the thin wall part intersect to each other to form one virtual circle, wherein an entrance portion of the orifice is disposed at the outside of the thin wall part and at the inside of a valve seat opening inner wall corresponding to the minimum inner diameter of the valve seat, and an exit portion of the orifice is disposed at the outer side in the radial direction of the axial center of the fuel injection valve with respect to the entrance portion, and wherein a concave portion is formed at the exit portion of each orifice by press working so that the orifice length of the outside in the radial direction of the axial center of the fuel injection valve is shorter than the orifice length of the inside in the radial direction, and each orifice is formed so as to stride over the bottom surface of the concave portion by press working.

2. The fuel injection valve according to claim 1, wherein the relationship between an orifice just-above height h represented by a distance in a valve seat axial direction between the center of the orifice entrance portion and a valve plug tip portion and an injection entrance diameter d is represented by $h \leqq 1.5\ d$ under a valve open state.

3. The fuel injection valve according to claim 1, wherein a columnar portion having a minimum cross-sectional area is formed between the orifice entrance portion and the concave portion in a flow passage of the orifice.

4. The fuel injection valve according to claim 1, wherein the valve seat is provided with a counter bore corresponding to a deformed portion of the upstream side of the orifice plate which occurs when the concave portion is formed at the downstream side of the orifice plate by press working.

* * * * *